United States Patent [19]

Kanno

[11] Patent Number: 4,858,586

[45] Date of Patent: Aug. 22, 1989

[54] METHOD AND DEVICE FOR IGNITING ENGINES

[75] Inventor: Seizo Kanno, Tokyo, Japan

[73] Assignee: Hiroyuki Hoshino, Kanagawa, Japan

[21] Appl. No.: 304,003

[22] Filed: Jan. 30, 1989

Related U.S. Application Data

[63] Continuation of Ser. No. 108,995, Oct. 16, 1987, abandoned.

[30] Foreign Application Priority Data

| | | | |
|---|---|---|---|
| Oct. 17, 1986 | [JP] | Japan | 61-246859 |
| Dec. 5, 1986 | [JP] | Japan | 61-289944 |
| Dec. 26, 1986 | [JP] | Japan | 61-312830 |

[51] Int. Cl.[4] ..... F02F 1/00

[52] U.S. Cl. ..... 123/620; 123/640; 123/146.5 A

[58] Field of Search ..... 123/606, 643, 146.5 A, 123/640, 634

[56] References Cited

U.S. PATENT DOCUMENTS

| | | | |
|---|---|---|---|
| 3,165,099 | 12/1962 | Vanderpool | 123/640 |
| 3,242,916 | 3/1966 | Coufal | 123/643 |
| 3,430,617 | 3/1969 | Elbordon | 123/640 |
| 4,153,030 | 5/1979 | Power | 123/146.5 A |
| 4,167,928 | 9/1979 | Pagel | 123/643 |
| 4,207,846 | 6/1980 | Borst | 123/643 |
| 4,216,755 | 8/1980 | Ordines | 123/643 |
| 4,233,949 | 11/1980 | Poirier | 123/643 |
| 4,245,594 | 1/1981 | Morino | 123/606 |
| 4,344,391 | 8/1982 | Mizutani | 123/146.5 A |
| 4,357,927 | 11/1982 | Igashira | 123/146.5 A |
| 4,457,286 | 7/1984 | Katayama | 123/643 |
| 4,483,293 | 11/1984 | Akasu | 123/643 |

OTHER PUBLICATIONS

Toyota "Mark II" excerpt, published Aug. 1988 by Toyota Motor Corporation.

T. Sugiura, "Theory and Practice of Ignition Systems", May 20, 1987, pp. 191-193.

Bosch GmbH, "Trouble-Shooting with the Oscilloscope", Jun. 1981.

*Internal Combustion Engine,* vol. 25, No. 317, (1986).

Nishio et al., "Information and Characteristics of Spark Plugs", Sankaido Co., Ltd., 1984.

Nippon Gaisi Co., Ltd. brochure, (no date).

Nippon Denso Co., Ltd. brochure, (no date).

*Internal Combustion Engine,* vol. 17, No. 212, (1978).

*Primary Examiner*—Raymond A. Nelli

*Attorney, Agent, or Firm*—Burns, Doane, Swecker & Mathis

[57] ABSTRACT

The present invention relates to an improved method and device for igniting engines of automobiles and the like, and more particularly for igniting the engines by applying the same secondary high voltage polarity to all of the spark plugs under each of both compression and exhaust strokes in the case of the so-called simultaneous ignition system.

24 Claims, 8 Drawing Sheets

METHOD AND DEVICE FOR IGNITING ENGINES

This application is a continuation of application Ser. No. 108,995, filed Oct. 15, 1987, now abandoned.

BACKGROUND OF THE INVENTION

1. Field of the Invention

The present invention relates to an improved method and device for igniting engines of automobiles and the like, and more particularly for igniting the engines by applying the same secondary high voltage polarity to all of the spark plugs under each of both compression and exhaust strokes in the case of the so-called simultaneous ignition system.

2. Description of the Prior Art

Recently, the high-powered engines for automobiles required for achieving accelerating ability and quick driving response as well as the greatest fuel economy has necessitated mounting a microcomputer with a sizeable memory in a car and controlling closely the ignition timing as well as the mixing ratio and quantity of air-fuel mixture according to actual driving conditions.

As regards the ignition device delivering an electric discharge by providing the spark plugs with a high voltage, the conventional ignition devices have often delivered the high voltage on the secondary side of the ignition coil after disconnecting a contact point of the distributor and have distributed such a high voltage to each cylinder through the distributor. Such devices have created problems such as damage to the above contact point or have been so unable to maintain their functions in a state of rapid rotation that it has been difficult for such devices to adapt to the above engine's performance. This is the reason why recently the above contact point has fallen out of use, and by the technique of generating the high voltage through turning transistors on and off, a large number of electronic ignition devices have been developed so far and put to practical use.

In addition, the above electronic ignition devices have further developed to include what is called the simultaneous ignition system which is currently employed in existing automobile engines.

FIG. 10 illustrates an example of an ignition device circuit with the above simultaneous ignition system. As shown in FIG. 10, among the spark plugs P1 to P6, a plug under compression stroke is combined with a plug under exhaust stroke (in the case of a six cylinder engine, for example, the 1st and 6th cylinders, 2nd and 5th cylinders, and 3rd and 4th cylinders might be paired) and they are connected to the sparking coils C1 to C3 from which both ends of the secondary coil are taken as the outputs. Once the transistors Q1 to Q3 connecting to the primary side of the above sparking coils C1 to C3 are turned on and off in sequence by trigger signals obtained through signals detected from the engine, the sparking coils will deliver a high voltage at the secondary side of the sparking coils. Thus such devices are arranged so that the plugs under compression strokes are ignited in sequence and, simultaneously, even the plugs under exhaust strokes are also ignited.

Even though it seems that the conventional ignition device's ignition under exhaust strokes is apparently useless, such devices have produced good effects in the prior art including prevention against a lower critical cooling rate for the spark plug and improvement in start-up as a result of improved control over idling rotation and torque variation. Nevertheless, significant offsetting negative effects have also been proven.

As shown distinctly in FIG. 10, a set of plugs P1 and P6 in a conventional ignition device is so connected to + and − sides of an ignition coil (C1) that such a device allows the spark plug set to experience lack of unity of polarity at discharge such that, for example, a spark plug P1 of the first cylinder always performs negative discharge, while the other one, P6 of the sixth cylinder, always performs positive discharge. Since the negative discharge is usually advantageous for the spark plug, the result is that the discharge efficiency in such spark plugs with positive discharge is lower than that of negative discharge, or their plugs are subject to serious damage. Furthermore, the engine, as a whole, not only has its balance made worse and the burning state of its spark plugs uneven due to their different discharge polarities, but also, as regards the spark plug, it will not be available to use with a timing light.

SUMMARY OF THE INVENTION

It is, accordingly, an object of the present invention to overcome the disadvantages in the prior art method and device for igniting engines by providing an improved method and device for igniting engines that can unify a high voltage polarity fed to the spark plugs in the case of the so-called simultaneous ignition system. The technique of this invention is that a polarity unified at all times under compression strokes as well as exhaust strokes makes the spark plugs discharge by varying the high voltage polarity fed to the spark plugs at a prescribed timing.

The first mode of the foregoing technique is achieved in one example by providing the spark plugs with the high voltage polarity after changing over between high voltages generated at the secondary side of their sparking coil at the prescribed timing.

In carrying out the invention in the above preferred mode it is extremely effective to make the spark plugs discharge by igniting the plugs simultaneously in both of a pair of cylinders which are under compression and exhaust stroke by appropriately grouping such spark plugs as operate 180° apart, and furthermore by applying the high voltage generated in the sparking coils to these spark plugs in series. In the above case, therefore, applying the high voltage of different polarities generated in the sparking coils to the spark plugs having a proper phase difference will allow the spark plugs to discharge at a polarity unified at all times under compression and exhaust strokes.

A configuration of a device to carry out the ignition method of the first mode, comprises among its features a rotor assembly composed of the following parts, for example: a first coil-connecting part that is attached near the middle of a substrate and allows its upper portion to be connected to an output end of the sparking coils and also allows its lower portion to function as an electrode part; a second coil-connecting part that is attached in the vicinity of the above first coil-connecting part and allows its upper portion to be connected to an output end of the sparking coils and also allows its lower portion to function as an electrode part; an electrode body that is attached opposite to the above first coil-connecting part and allows its upper portion to be connected to the spark plugs and also allows its lower portion to include a plurality of plug-connecting parts, or electrode parts; a first short-circuiting part which is formed so that it is able to rotate according to a crank angle of engine, taking up a position opposite to the above electrode body so as to electrically short-circuit between the electrode parts located in the above first coil-connecting part and the plug-connecting part; and a second short-circuiting part that will short-circuit between the electrode parts located in the above second coil-connecting part and the foregoing plug-connecting part.

The second mode of the foregoing technique of this invention is achieved in one example by varying a polarity of the sparking coils to be used for impressing a high voltage to the spark plugs by changing over the polarity of voltage fed to the sparking coil's primary side at the prescribed timing.

In carrying out our invention, the above preferred mode is applied to respective sets of spark plugs connected by an ignition circuit which makes it possible to generate a high voltage necessary for performing a discharge of the spark plug and also to change over the polarity of high voltage at the output ends. In other words, the above ignition circuit actuated by a signal according to a crank angle of its engine makes the foregoing spark plugs discharge at a unified polarity under compression and exhaust strokes.

In addition, the technique of this invention involves allowing air-fuel mixture ions collected in the vicinity of a center electrode to develop an inversion layer when the spark plugs ignite, enhancing a discharging efficiency by increasing greatly a particle velocity between discharging gaps, by allowing such spark plugs to be charged in advance by a polarity different from a high voltage fed for discharging the plugs.

EFFECTS AND ADVANTAGES OF THE INVENTION

Although effects of the present invention will have become apparent from the description of the foregoing Summary of the Invention, further detailed effects shall be clarified as follows. According to the first preferred mode of ignition, an ignition circuit that provides a high voltage necessary for discharging a spark plug, after changing over a polarity at its output ends, is connected to respective sets of the spark plugs, allowing the above spark plugs to be actuated for discharging according to a crank angle of the engine, and at a polarity unified under compression and exhaust strokes, by signals corresponding to strokes of each cylinder.

As a result, the spark plug discharges at the unified polarity at all times in such a way that, for example, its spark plug will perform negative discharge under compression stroke and positive discharge under exhaust strokes. According to the second mode for ignition, since different polarities of a high voltage generated in the sparking coil are applied to the spark plug at an appropriate phase difference, such spark plug will be able to discharge, in the case of all cylinders, at the unified polarity. For example, it will perform negative discharge under compression strokes and positive discharge under exhaust strokes.

When the plugs under compression and exhaust strokes ignite at the same time, our present invention allows the spark plugs to discharge at a unified polarity at all times under compression and exhaust strokes. As a result, each spark plug can perform an advantageous negative discharge. Unlike conventional methods for spark plugs comprising mixed systems of positive and negative discharges, there is no discharge efficiency degradation in the case of the present invention. Moreover, negative aspects which have been observed among the conventional spark plugs as well as the engine as a whole are that not only is the engine's balance made worse and the burning state of spark plugs uneven due to their polarity, but also, as regards the spark plugs, they are not available to use with a timing light.

These problems, however, can be eliminated by the techniques of the invention. Furthermore, a unique advantage to be emphasized is that the invention provides a means of increasing discharge efficiency stemming from the following actions of the center electrode during exhaust, admission, and compression strokes. Since a positive-charge center electrode under exhaust stroke enters into compression stroke at a stage when the negative air-fuel mixture ions in an air-fuel mixture concentrate under admission stroke, such a center electrode changes into a negatively-charged one and will attract the positive air-fuel mixture ions. As a result, the above center electrode will bring about an inversion layer of air-fuel mixture and will allow a particle velocity between discharge gaps to greatly increase and accordingly enhance the discharge efficiency.

Furthermore, in carrying out the invention, it is possible to adopt with modification a conventional configuration at the primary side of sparking coils to save money.

DETAILED DESCRIPTION OF THE PREFERRED EMBODIMENTS

Figure 1:
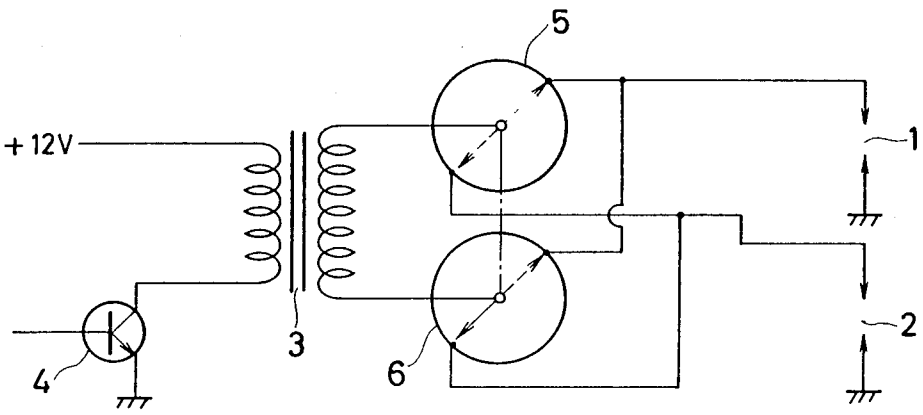
FIG. 1 shows a schematic diagram of the first embodiment of the method of the present invention.

The first embodiment of the invention will now be described in detail by way of the drawing figures.

FIG. 1 is a conceptual diagram showing the first embodiment of the invention. Techniques for an engine ignition method are broken down as follows, among which only the simultaneous ignition method is the same as employed by the conventional approach.

Spark plugs which at a particular instant operate under compression and exhaust strokes, respectively, are combined. (In the case of a six cylinder engine, the combination of cylinders shall be 1st and 6th cylinders, 2nd and 5th cylinders, and 3rd and 4th cylinders, but only spark plugs 1 and 2 of the 1st and 6th cylinders are shown in FIG. 1.)

Both ends of the secondary coil are taken as outputs, and it is necessary to use a sparking coil 3 that is able to develop a high voltage of different polarities.

A high voltage is developed at the secondary side of the sparking coil 3 by turning transistors 4 connecting to the primary side of the sparking coil 3 on and off, and then the above high voltage is applied in series to the plugs which are under compression and exhaust stokes for igniting these plugs simultaneously.

Furthermore, in carrying out such an embodiment, mounting switch parts 5 and 6 between a spark plug and coil makes the spark plug discharge at a unified polarity at all times during strokes of compression and exhaust by applying, with the appropriate phase difference, the high voltage of different polarities that is developed to the sparking coil 3.

It is apparent in FIG. 1 that when the lst cylinder is under compression strokes, the 6th cylinder is under exhaust strokes, and when a negative high voltage is charged to the spark plug of the 1st cylinder through a switch part 5, a positive high voltage will be charged to the spark plug of the 6th cylinder through a switch part 6 having a phase difference of 180° (360° in terms of the engine's crank angle).

Even though no explanation is found by way of FIG. 1, as a matter of course, the high voltage having the above polarity is fed in sequence from the 2nd cylinder (negative) in series to the 5th cylinder (positive) and from the 3rd cylinder (negative) to the 4th cylinder (positive).

With regard to a state shown in FIG. 1, if the crankshaft rotates by 360°, the 1st cylinder is under exhaust stroke and the 6th cylinder is under compression stroke. In this state, the switch parts 5 and 6 are shown by a dotted line in FIG. 1. Accordingly, a positive high voltage is applied to the spark plug of the 1st cylinder and a negative high voltage is applied to that of the 6th cylinder. Thus, like the above situation, a high voltage of the above alternating polarity will be fed in sequence from the 2nd cylinder to the 5th cylinder and from the 3rd cylinder to the 4th cylinder.

And needless to say, the above configuration realizing the ignition method of this invention is applicable to engines other than six cylinder ones.

The following devices, for example, are available for the above switch parts 5 and 6.

Figure 2A:
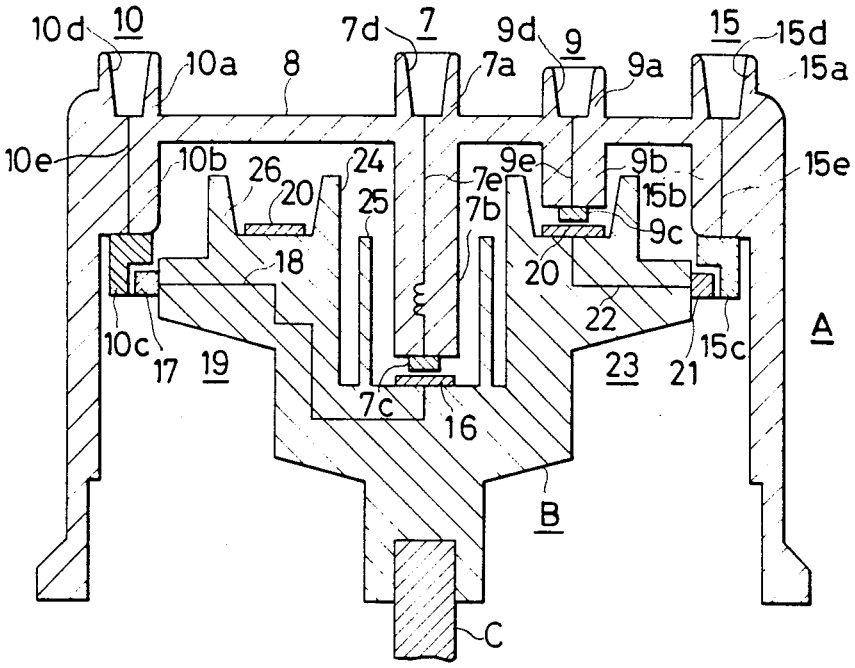
FIG. 2*a* is a sectional view of one embodiment showing a device of the present invention and FIG. 2*b* is a plan view of the above device.
Figure 2B:
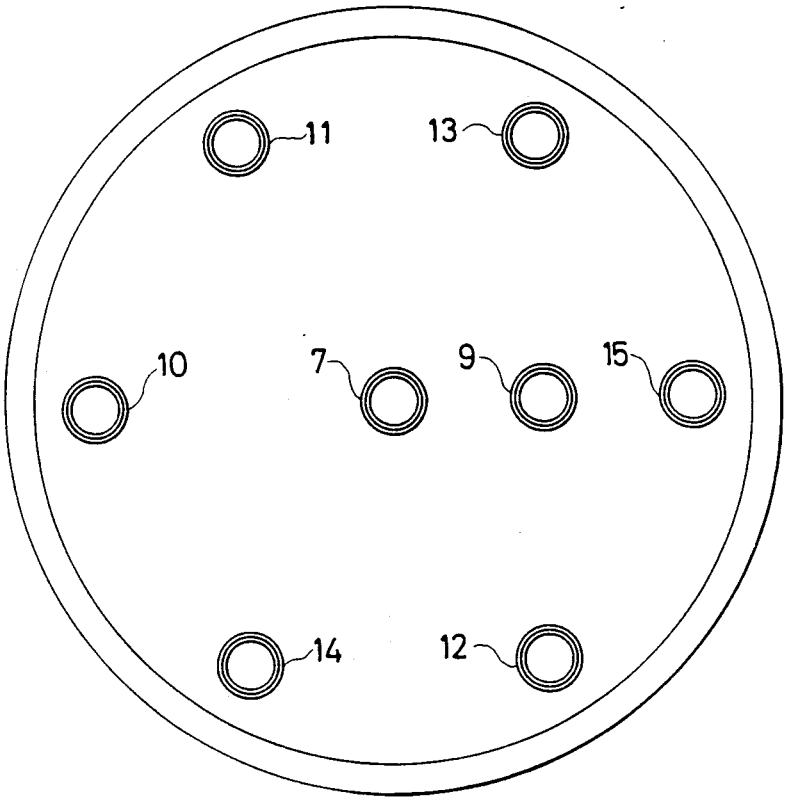

As shown in FIG. 2, a cap part A to be used for the ignition device of this invention is composed of respective parts as follows: a first coil-connecting part with an open electrode 7*c* at a point of a lower protruding part 7*b* is attached near the middle on the substrate 8. An upper protruding part 7*a* is connected to one output end of the sparking coil. A second coil-connecting part with an open electrode 9*c* at a point of a lower protruding part 9*b* is attached to the vicinity of first coil-connecting part 7, while an upper protruding part 9*a* is connected to another output end of the sparking coils, and also 10 to 15 are attached circumferentially on the substrate 8, spaced at an identical interval and having the above first coil-connecting part 7 as the center of the substrate. Upper protruding parts 10*a* to 15*a* are connected to the spark plugs of each cylinder and there is a plug-connecting part with open electrodes 10*c* to 15*c* (some of them are not illustrated) at a lower end of parts 10*b* to 15*b*.

The configuration of this cap part A is almost identical with that of the conventional known distributor cap. As regards the configurations of coil-connecting parts 7 and 9 as well as plug-connecting parts 10 to 15, for example, cuplike conductive parts 7*d*, 9*d*, and 10*d* to 15*d* will be recessed within respective upper protruding parts, and it is preferable to allow the above conductive parts to connect to the open electrodes 7*c*, 9*c*, 10*c* to 15*c* with the aid of conductors 7*e*, 9*e*, 10*e*, to 15*e*.

Part B is closely fitted to a rotor shaft C rotating in proportion to a crank angle of the engine to the foregoing cap part A. On rotor part B are mounted a first short circuit part 19 and second short-circuit part 23. Positioned at the places corresponding to open electrodes 7*c* and 10*c* are electrode parts 16 and 17 coupled through a conductor 18 at the above first short-circuit part 19 so that open electrode 7*c* of the first coil-connecting part 7 is electrically connected to open electrodes 10*c* to 15*c* of the above plug-connecting parts 10 to 15, and positioned at a place corresponding to that of the above open electrode 9*c* is a circular electrode part 20 connected to an electrode 21 (which is similar to an open electrode 7*c* of the foregoing first coil-connecting part 7) through a conductor 22 at the above second short-circuit part 23, so that an open electrode 9*c* of the above second coil-connecting part 9 is electrically connected to the open electrodes 10*c* to 15*c* of the above plug-connecting parts 10 to 15.

A lower protruding part 7*b* located at the first coil-connecting part 7 is inserted in a tubular wall portion 25 which is set in a recessed portion 24 in the middle of rotor portion B, and a wall portion 26 is provided as well as the inner and outer circumference of the circular electrode mode 20. In this manner, all the parts are designed to prevent discharge due to close wiring of high voltages having different polarities.

Being constructed in such a manner as described above, an ignition device of the present invention allows one output of the sparking coil 3 to connect to the first coil-connecting part 7 and other output of the sparking coil 3 to connect to the above second coil-connecting part 9 and, accordingly, the spark plugs which are under compression and exhaust strokes are combined in the following way, for example: 1st cylinder to 6th cylinder, 2nd cylinder to 5th cylinder, and 3rd cylinder to 4th cylinder. Thus respective plugs are connected to plug connecting parts that are diametrically opposite each other, such as 1st cylinder to plug-connecting part 10 and 6th cylinder to plug-connecting part 15. Consequently, when the 1st cylinder is under compression stroke and a negative high voltage is applied to its spark plug through the above first short-circuiting part 19, a positive high voltage is applied to the 6th cylinder through the second short-circuiting part 23, and a high voltage with this polarity will be fed in sequence from the 2nd cylinder (negative) in series to the 5th cylinder (positive) and from the 3rd cylinder (negative) to the 4th cylinder (positive).

Moreover, once the crankshaft rotates 360 degrees and the 1st cylinder shifts to the exhaust stroke, a positive high voltage is applied through the second short-circuiting part 23 and a negative high voltage is applied to the 6th cylinder that is under compression stroke through the first short-circuiting part 19 and then, in like manner, a high voltage with the above polarity will be fed in order from the 2nd cylinder to the 5th cylinder and from the 3rd cylinder to the 4th cylinder.

Under this situation, so long as electric currents of coil-connecting parts 7 and 9 can be distributed in sequence to the plug-connecting parts 10 to 15, the composition of each short-circuiting part 19 or 23 is not specially subject to restriction and, for example, it is not always necessary for an open electrode 9c of the above second coil-connecting part 9 to come into contact with a circular part 20 arranged at a position corresponding to the above electrode 9c, and it is sufficient for the above two parts to develop a discharge or a conduction with respect to each other.

Next the second embodiment of the invention will be described in detail by way of FIGS. 3–5.

Figure 3:
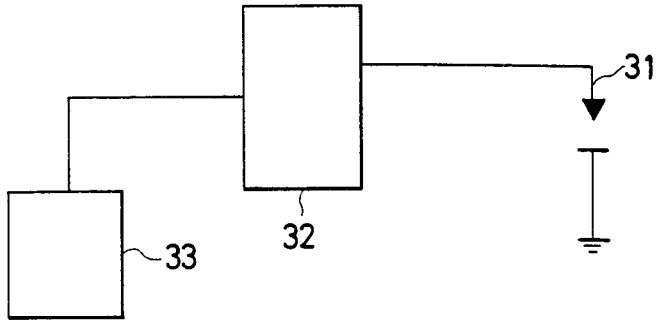
FIG. 3 is a conceptual diagram of the second embodiment of the method of the present invention.

FIG. 3 is a conceptual diagram showing the second embodiment of this invention, and spark plug 31 represents spark plugs in each cylinder of the engine (not illustrated). Although only one spark plug among them is shown in FIG. 3, it is admissible for the spark plugs of this invention to be handled singly or in terms of properly combined sets.

Block 32 represents an ignition circuit having respective members such as an ignition coil and the like built in to develop a high voltage necessary for discharging the spark plugs. While the arrangement for developing a high voltage in the ignition circuit 32 may take any form, it is arranged so that a polarity of the high voltage at an output end can be changed over by an appropriate measure.

Block 33 is a sensor to detect signals corresponding to crank angles of the engine and, in the case of this embodiment, its detection of crank angles helps to form an ignition timing signal in each cylinder, but a conventional known arrangement can be employed for this sensor 33.

This invention, however, allows the above ignition circuit 32 to be operated through the ignition timing signals delivered by the above sensor 33 and also allows the above spark plug 31 to discharge at a unified polarity under compression and exhaust strokes.

Figure 4:
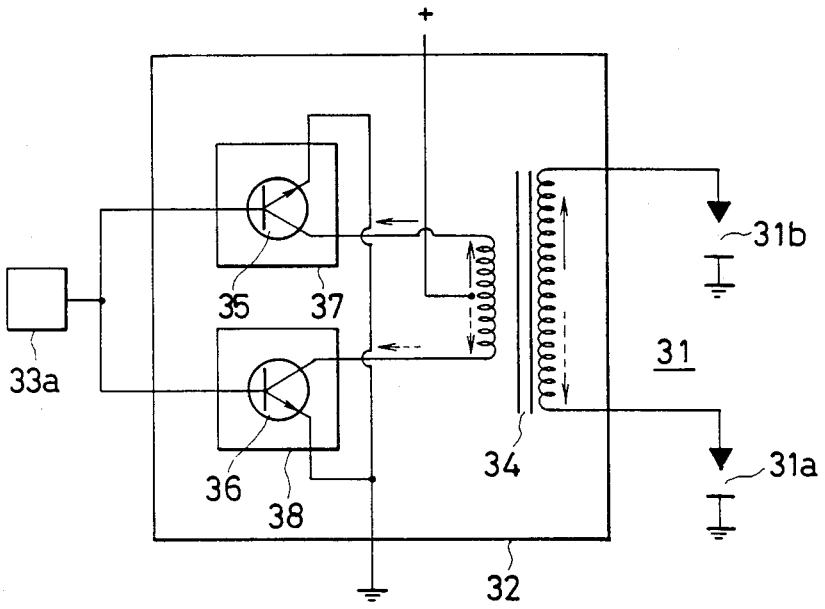
FIG. 4 is a circuit diagram of the second embodiment of the method of the present invention.
Figure 5:
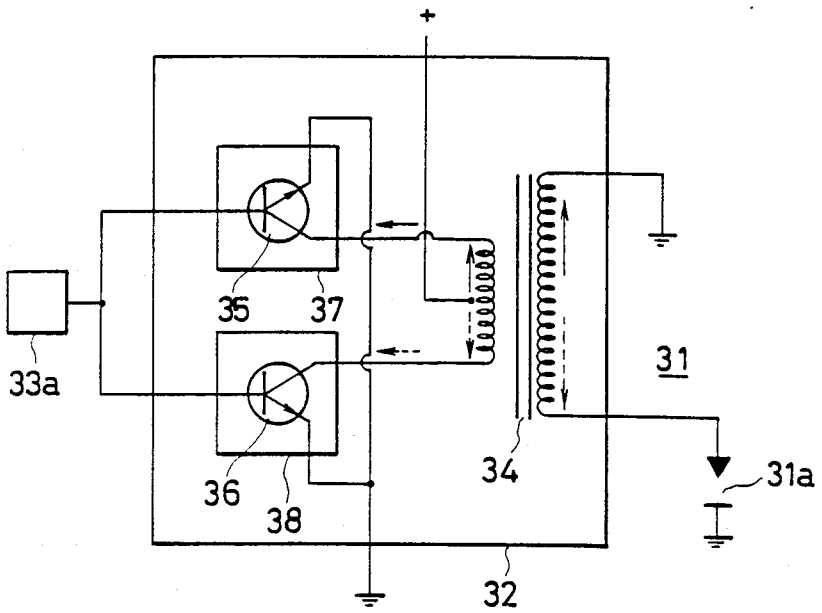
FIG. 5 is an alternate circuit diagram of the second embodiment of the method of the present invention.

The invention's techniques concerning the above second embodiment will become apparent from the following description with reference to accompanying FIG. 4. As to a spark plug 31 shown in FIG. 4, paired in an ignition set consisting of spark plugs 31*a* and 31*b*, the set will experience an ignition operation such that if one of them is under compression stroke, the other one is under exhaust stroke in its cylinder. (In the case of the 6 cylinder engine, the combinations of spark plugs are: 1st cylinder to 6th cylinder, 2nd cylinder to 5th cylinder, 3rd cylinder to 4th cylinder. Only spark plugs 31*a* and 31*b* are shown in FIG. 4 for simplicity.) As regards an ignition circuit 32, both ends of the secondary coil are taken as outputs, the secondary coil in the particular embodiment being composed of a sparking coil 34, which enables a midpoint of the primary coil to be connected, as well as ignitor circuits 37 and 38 mainly consisting of power transistors 35 and 36.

In the above ignition circuit 32, the foregoing ignitor circuits 37 and 38 connect to both ends of the primary side of sparking coil 34 and a power source connects to the primary side's midpoint. Moreover, the foregoing spark plugs 31*a* and 31*b* are connected to the secondary side of sparking coil 34 and a sensor 33*a* forming the ignition timing signals in the 1st and 6th cylinders is connected to the above ignitor circuits 37 and 38.

Under this situation, the method for igniting engines of the present invention is embodied by the foregoing ignition system as follows.

Once the 1st cylinder is in the vicinity of compression top dead center as shown in FIG. 4, the 6th cylinder will be near exhaust top dead center. As a result, if this state is detected by the sensor 33*a*, the power transistor 35 of the above ignitor circuit 37 is triggered and it allows an electric current to flow as shown by a broken line in FIG. 4. In this case, a negative high voltage is applied from the secondary side of the sparking coil 34 to the 1st cylinder's spark plug 31*a* which is under compression stroke and also a positive high voltage is applied from the secondary side of sparking coil 34 to the 6th cylinder's spark plug 31*b* which is under exhaust stroke.

As mentioned above, when the crankshaft rotates 360 degrees, the 1st cylinder will be near exhaust top dead center and accordingly the 6th cylinder will be in the vicinity of compression top dead center. Thus this state is detected by the sensor 33*a* and the power transistor 36 of the above ignitor circuit 38 is triggered and it allows an electric current to flow as shown by a solid line in FIG. 4. While a positive high voltage is applied from the secondary side of sparking coil 34 to the spark plug 31*a* of the 1st cylinder that is under exhaust stroke, a negative high voltage is applied from the secondary side of sparking coil 34 to the 6th cylinder spark plug 31*b* that is under compression stroke.

Therefore, if the ignition circuit 32 and sensor 33 are adopted for other combinations in addition to the above spark plugs 31*a* and 31*b*, such other methods may employ the identical ignition method as mentioned above.

Such triggering of the power transistors is performed by turning such transistors On and Off, and some measure of high voltage develops not only at the Off time but also at the On time. If there is any trouble in such a case, it is preferable to provide some barriers such as gaps and the like at proper intervals along the wiring path towards the spark plugs.

A high voltage with different polarities can be developed by using sparking coils that are able to generate the above high voltage without relying on two sparking coils as mentioned above.

One embodiment of the invention handles combined sets of spark plugs of which if one of them is under compression stroke, the other one is under exhaust stroke. However, the second embodiment of this invention is not limited to the above case but it may involve a handling of each sparking plug as a single unit as illustrated in FIG. 5.

While as to one embodiment as mentioned above, open electrode parts 10*c* to 15*c* corresponding to plug-connecting parts 10 to 15 are provided just under the above plug-connecting parts, in the case where the device of our invention is applied, for example, to V-type six cylinder engines, its plug-connecting part may be connected with the open electrode part through a proper measure to reduce a distance from device to plug.

Figure 6:
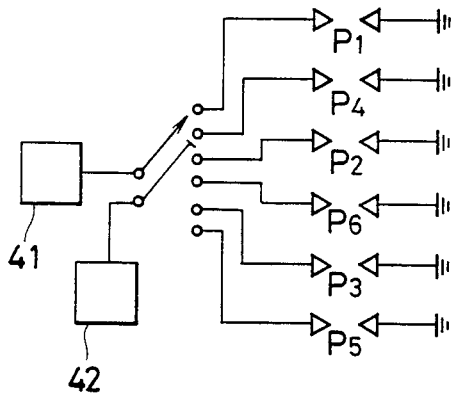
FIG. 6 is a conceptual diagram of techniques to be incorporated into this invention.

An effective method for igniting engines is apparent from FIG. 6 as a third embodiment of this invention which shows a combination ignition method.

It is desirable to allow spark plugs to be charged in advance by a polarity different from the high voltage fed for discharging the plugs. Such spark plugs charged by a different polarity cause air-fuel mixture ions to be sucked in toward a center electrode, developing an inversion layer when the spark plugs ignite and accordingly enhancing a discharging efficiency by greatly increasing a particle velocity between discharging gaps.

The ignition method and its devices regarding the preferred embodiment will be described in detail as follows with reference to the accompanying FIGS. 6–9.

FIG. 6 serves the purpose of explaining a conception of the method relating to the third embodiment of this invention. A high voltage that is developed in a high voltage generating circuit 41 for discharging is applied through operation of change-over circuit 42 (more generally, distributor 42) to spark plugs P1 to P6 in a cylinder which is located in the vicinity of compression top dead center in accordance with the predetermined order in the case of straight-type six cylinder engines such as 1-4-2-6-3-5, and continuous explosions in each cylinder allow its engine to maintain its rotation.

The third embodiment of this invention provides a second voltage generating circuit 42 to develop a voltage of polarity different from a high voltage which is developed through the above high voltage generating circuit 41 to discharge spark plugs, and then this embodiment adopts an approach where a voltage developed by this circuit 42 allows a spark plug (that is, the spark plug P4 in the 4th cylinder shown in FIG. 6 and just about to spark) to be charged by a voltage different from a high voltage for discharging.

As mentioned above, this approach allows a spark plug just before discharging to be charged in advance by a polarity different from a high voltage to be fed for discharging. Such a high voltage for discharging can be generated by any possible method. So long as a voltage having a different polarity or a state of voltage fed to spark plugs doesn't result in discharging, such a voltage may have a polarity different from a high voltage for discharging.

Thus such a high voltage can be developed in the same manner as a high voltage for discharging as mentioned above or by a different manner. In the case of the former, the voltage may be lowered by means of appropriate measures such as resistance or a high pressure diode and the like. In the case of the latter, the voltage may be left as it is or lowered in like manner mentioned above.

As regards various ignition systems which have been put to practical use, since they have already adopted some arrangements to develop a high voltage having different polarities simultaneously, it would be convenient for the present invention to utilize any one among them.

A voltage of a polarity different from a high voltage that is developed is likewise fed to spark plugs through proper measures, preferably through a dedicated wiring provided for them. But it is possible to superpose such wiring on the regular plug cord.

Figure 7:
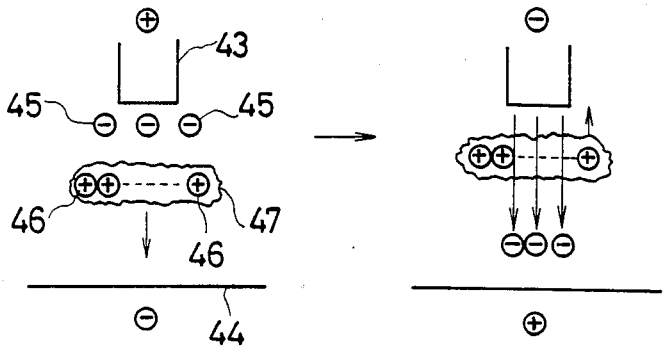
FIG. 7 is a diagram showing ion movement when the techniques of FIG. 6 are put in operation.

As mentioned above, when spark plugs are ignited, a voltage is impressed so that a center electrode 43 is made positive prior to discharging as shown in FIG. 7 and a side electrode 44 is made negative, on the supposition that its ignition is carried out with negative discharging, and consequently ions (incidentally existing ions) located between two electrodes 43 and 44 start moving, and $\alpha$ emission where the concerned ions dislodge other ions after coming into collision with atoms and emission where negative ions are expelled through electrical neutralization occur to an extent but not sufficient to result in electrical discharge. Negative ions 45 gather around the center electrode 42 having a pointed shape as shown in FIG. 7. On the other hand, the positive ions 46 move so slowly that they will form an ionic cloud 47, taking up positions between the two electrodes 43 and 44.

Under this situation, if a negative high voltage is applied to the center electrode 43 for discharging, the polarity of the two electrodes 43 and 44 is reversed. Then with the movement of ionic cloud 47 of positive ions towards the center electrode 43, the negative ions 45 will move quickly to side electrode 44, resulting in an inversion of the ions' direction of movement. Alpha emission where ions eject other ions after coming into collision with other atoms becomes extremely active and serves the purpose of improving discharge ignition efficiency.

In addition, it is possible for our approach described above to use a device as shown in FIG. 2 of our first embodiment.

Thus, an output from a high voltage generating circuit for discharging the spark plugs is connected to the first coil-connecting part 7 and a circuit for generating a voltage of polarity different from the high voltage for discharging is connected to the second coil-connecting part 9 and then each plug is connected to plug electrode parts 10 to 15 corresponding to each plug. As a result, when the 6th cylinder is under compression stroke and the high voltage for discharging is applied through the above second short-circuiting part 23, the voltage of polarity different from the high voltage for discharging is applied in advance through the above first short-circuiting part 19 to the spark plug of the 6th cylinder resulting in the plug being charged with a voltage of such polarity.

And when the second cylinder moves to compression stroke with the rotation of crankshaft, the high voltage is applied for discharging through the second short-circuiting part 23 and accordingly, in like manner prescribed above, the voltage of a polarity different from the high voltage is fed from the first short-circuiting part 19 to such spark plugs.

While as to one embodiment as mentioned above, open electrode parts **10*c* to 15*c* corresponding to plug electrode parts 10 to 15** are provided just under the above plug electrode parts, in the case where the device of the invention is applied, for example, to V-type six cylinder engines, its plug electrode part may be connected with the open electrode part through a proper measure to reduce a distance from device to plug.

Although in the case of the first embodiment, the first and second short-circuiting parts are formed as a whole, it is unnecessary for this device to be limited in that manner. Notwithstanding that a voltage different from a high voltage for discharging spark plugs is fed to each spark plug, if such a voltage doesn't cause discharge, the second electrode part 10, like an embodiment mentioned above, may short-circuit to the plug electrode parts 10 to 15 through the first short-circuiting part 19. However, when such spark plugs are likely to discharge under the aforementioned voltage, it is preferable to lower such voltage to a certain extent by properly using resistance or a high pressure diode and the like, and the direct contact between the open electrodes **10*c* to 15*c* of the plug electrode part and electrode 17, as well as the open electrode 9*c* and electrode 20**, is not recommended. On the contrary, it would be better to form some gaps among them or to have some capacitor connections among them.

Both the first short-circuiting part 19 and second short-circuiting part 23 are arranged so that they rotate with a phase difference determined by the number of the engine's cylinders. However, since we refer to the six cylinder engine in the case of the above embodiment, the above parts are formed to have a phase difference of 60 degrees.

In connection with the techniques to be adopted in carrying out our invention by the above devices mentioned in one embodiment of the present invention, when the spark plugs which are under compression stroke are sparked by means of negative discharging, such plugs are so charged in advance by a voltage having a polarity different from the high voltage to be used for sparking such that the polarity reverses itself from positive to negative in the vicinity of the center electrode with each discharging and an inversion layer of ions existing between the electrodes delivers active $\alpha$ emission and greatly improves discharge ignition efficiency.

Engines adopting this approach, therefore, allow failures in ignition to be minimized and operations to be performed not only smoothly and quietly but also without causing any trouble even when a lean mixture is given. Thus this approach enhances operational performance of the engine and spark plug life is increased because fouling is greatly reduced. Moreover, with the decrease of carbon accumulated in the engine, engine oil is dirtied less quickly making its changing cycle longer and saving considerable money.

Figure 8:
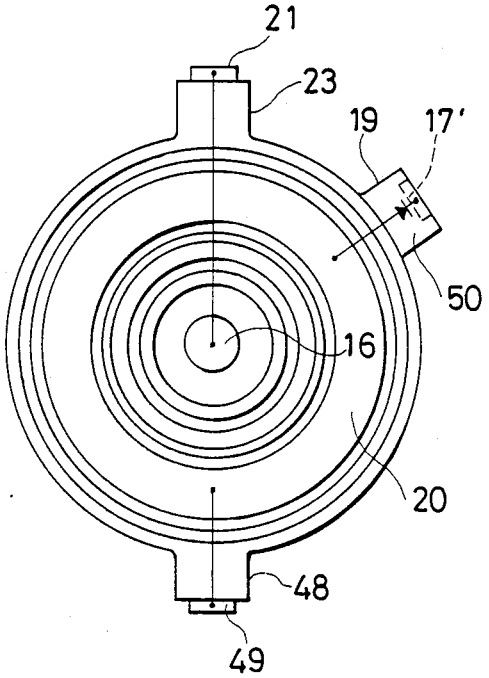
FIG. 8 is a plan view of a rotor part to be used for the third embodiment.
Figure 9:
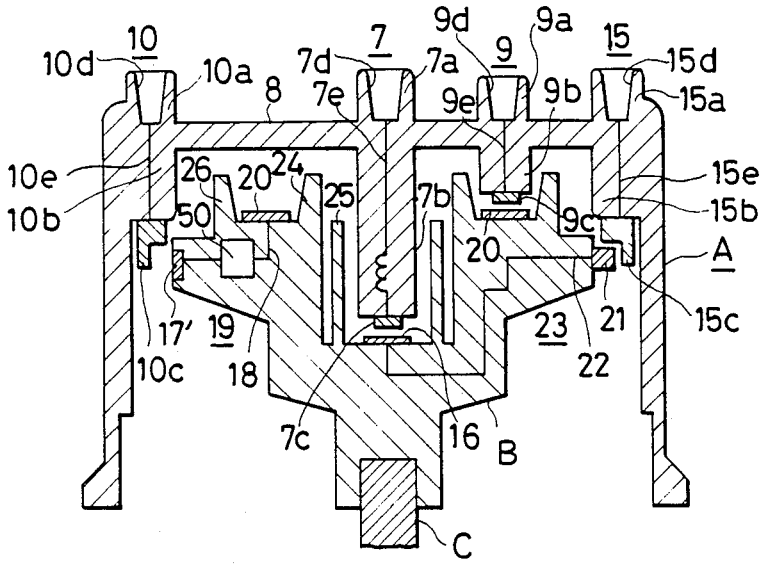
FIG. 9 is a sectional view of the third embodiment using the rotor part shown in FIG. 8.
Figure 10:
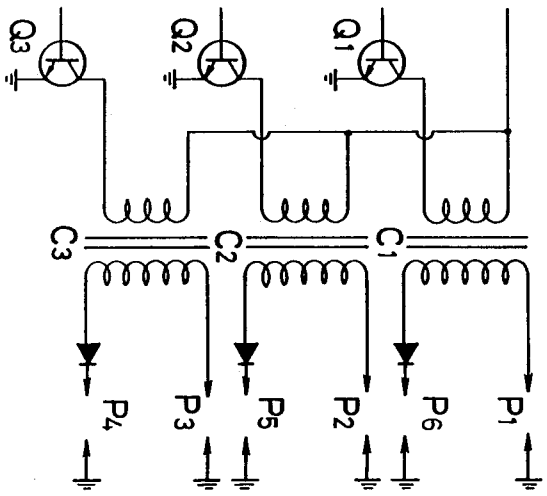
FIG. 10 is a schematic diagram of a conventional method.

If the above approach is adopted together with a simultaneous ignition system in the same manner of this invention, it is preferable for the above rotor part B to be arranged, for example, as shown in FIG. 8 (numerals applied in FIG. 2 being identical with those of FIG. 8).

In other words, a short-circuiting part 48 for exhaust strokes is protrudingly attached to the rotor part B shown in FIG. 2*a* by making it oppose the above second short-circuiting part 23 and an electrode 49 is arranged at the point of the short-circuiting part 48 and its electrode 49 is connected to the above circular electrode 20. Since, in this case, a high voltage for making the spark plugs discharge is fed to the second electrode part 9, it would be safer for the open electrode 17 of the above first short-circuiting part 19 not to connect directly to the above electrode 20 but connect to it through an appropriate resistance or high pressure diode 50. Furthermore, its point part doesn't project from its electrode 17 but is set by burying it inside the electrode.

The rotor part B composed in this way is used likewise as in the above mentioned embodiment. In other words, it is put to use together with the electrode body A comprising the first electrode part 7 and second electrode part 9 as well as the plug electrodes 10 to 15.

Being used in such a manner as mentioned above, an ignition device of the present invention for example, allows one output of the sparking coil that can develop a high voltage having a different polarity to connect to the first electrode part 7 and other output of the sparking coil to connect to the above second electrode part 9, and accordingly the spark plugs which are under compression and exhaust strokes are appropriately combined such as 1st cylinder to 6th cylinder, 2nd cylinder to 5th cylinder, and 3rd cylinder to 4th cylinder. Thus respective plugs are connected to each plug-connecting parts that are diametrically opposite each other such as 1st cylinder to plug-connecting part 10 and 6th cylinder to plug-connecting part 15. Consequently when the 1st cylinder is under compression stroke and a negative high voltage is charged to its spark plug through the above second short-circuiting part 23, a positive high voltage is applied to the 6th cylinder through the short-circuiting part 48 for exhaust strokes and a high voltage with this polarity will be fed in sequence from the 2nd cylinder (negative) in series to the 5th cylinder (positive) and from the 3rd cylinder (negative to the 4th cylinder (positive).

Moreover, once its crankshaft rotates 360 degrees and the 1st cylinder shifts to exhaust stroke, a positive high voltage is applied through the short-circuiting part 48 for exhaust strokes and a negative high voltage is applied to the 6th cylinder that is under compression stroke through the second short-circuiting part 23 and then, in like manner, a high voltage with the above polarity will be fed in order from the 2nd cylinder to the 5th cylinder and the 3rd cylinder to the 4th cylinder.

Besides being fed by a negative high voltage under compression stroke, the spark plugs are electrified by an advance positive electricity through the first short-circuiting part 19. As a result, a polarity inversion is carried out at a center electrode with each discharge.

What is claimed is:

1. An ignition method for an engine having at least one cylinder with a spark plug, said cylinder operating according to a cycle having a compression stroke portion and an exhaust stroke portion, comprising the steps of:

firing the spark plug of said cylinder during its compression stroke using a voltage of one polarity; and firing the spark plug of said cylinder during its exhaust stroke using a voltage of another polarity.

2. The method of claim 1 wherein the voltage of said other polarity is used to fire said spark plug at a prescribed time following the use of the voltage of said one polarity to fire said spark plug.

3. The method of claim 2 wherein said voltages are generated at opposite ends of a sparking coil.

4. The method of claim 3 wherein said engine has at least two cylinders having spark plugs and operating according to said cycle, the voltage of said one polarity being applied to the spark plugs of said cylinders during their compression strokes and the voltage of said other polarity being applied to the spark plugs of said cylinders during their exhaust strokes.

5. The method of claim 4 wherein said engine comprises at least one pair of cylinders having 180° out of phase with one another, and wherein the voltage of said one polarity is used to fire the spark plug of one cylinder of said pair simultaneously with the voltage of said other polarity being used to fire the spark plug of the other cylinder of said pair.

6. The method of claim 5 wherein the spark plugs of said pair of cylinders are fired simultaneously, one during the compression stroke of its cylinder and the other during the exhaust stroke of its cylinder, said spark plugs being connected in series with said sparking coil.

7. The method of claim 6 wherein the voltage of said other polarity is used to fire the spark plug of each cylinder at a predetermined phase in its cycle following the use of the voltage of said one polarity to fire the spark plug.

8. The method of claim 2 wherein both of said voltages are generated in sequence at a single end of a secondary side of a sparking coil by reversing the polarity of a primary voltage supplied to a primary side of said sparking coil.

9. The method of claim 5 wherein the voltage of said other polarity is used to fire the spark plug of one of said cylinders after the voltage of said one polarity is used to fire the same, by reversing the polarity of voltages generated at opposite ends of said sparking coil.

10. The method of claim 9 wherein an ignition circuit reverses the polarity of a primary voltage in response to a signal indicating a prescribed crank angle of the engine.

11. The method of claim 1 wherein a lesser voltage insufficient to cause said spark plug to fire is generated and applied to said spark plug just before the voltage of said one polarity is used to fire said spark plug during said compression stroke.

12. The method of claim 11 wherein a close succession of the use of the voltage of said one polarity to fire said spark plug after the application of said lesser voltages produces an ion inversion between electrodes of said spark plug in which clouds of oppositely charged ions are caused to pass through one another, thereby enhancing discharge efficiency.

13. An ignition apparatus for an engine having at least one cylinder with a spark plug, said cylinder operating according to a cycle having a compression stroke portion and an exhaust stroke portion, comprising:

means for firing said cylinder during its compression stroke using a voltage of one polarity; and means for firing said cylinder during its exhaust stroke using a voltage of another polarity.

14. The apparatus of claim 13 wherein the voltage of said other polarity is used to fire said spark plug at a prescribed time following the use of the voltage of said one polarity to fire said spark plug.

15. The apparatus of claim 14 further comprising an ungrounded sparking coil for generating said voltages at opposite ends thereof.

16. The apparatus of claim 15 wherein said engine has at least two cylinders having spark plugs and operating according to said cycle and at least one pair of cylinders having cycles 180° out of phase with one another, the voltage of said one polarity being applied to the spark plugs of said cylinders during their compression strokes and the voltage of said other polarity being applied to the spark plugs of said cylinders during their exhaust strokes.

17. The apparatus of claim 16 wherein spark plugs of cylinders having cycles 180° out of phase with one another are grouped together.

18. The apparatus of claim 17 wherein said sparking coil is connected in series with spark plugs of cylinders having cycles 180° out of phase with one another, to simultaneously ignite a pair of cylinders one of which is under compression stroke and the other of which is under exhaust stroke.

19. The apparatus of claim 18 wherein the voltage of said other polarity is used to fire the spark plug of each cylinder at a predetermined phase in its cycle following the use of the voltage of said one polarity to fire the same.

20. The apparatus of claim 15 further comprising means for reversing the polarity of a primary voltage supplied to a primary side of said sparking coil to generate in sequence at a single end of a secondary side of said sparking coil the voltage of said one polarity and the voltage of said other polarity.

21. The apparatus of claim 16 further comprising an ignition circuit connected to the groups of said spark plugs, said ignition circuit generating said voltages at opposite ends of said sparking coil and reversing the polarity of said primary voltage.

22. The apparatus of claim 21 wherein said ignition circuit is actuated by a signal indicating a prescribed crank angle of said engine.

23. The apparatus of claim 13 further comprising means for generating a lesser voltage insufficient to cause said spark plug to fire and applying said lesser voltage to said spark plug just before the voltage of said one polarity is used to fire said spark plug during said compression stroke.

24. The apparatus of claim 23 wherein a close succession of the use of the voltage of said one polarity to fire said spark plug after application of said lesser voltage produces an ion inversion between electrodes of said spark plug in which clouds of oppositely charged ions are caused to pass through one another, thereby enhancing discharge efficiency.

* * * * *